US006163885A

United States Patent [19]

Webb

[11] Patent Number: 6,163,885

[45] Date of Patent: Dec. 26, 2000

[54] PALMAR SPRINGS FOR SPACESUIT GLOVES

[75] Inventor: Paul Webb, Yellow Springs, Ohio

[73] Assignee: AlliedSignal Inc., Morristown, N.J.

[21] Appl. No.: 09/192,807

[22] Filed: Nov. 16, 1998

[51] Int. Cl.[7] ..... A41D 19/00

[52] U.S. Cl. ..... 2/166; 2/2.11; 2/161.6; 602/21

[58] Field of Search ..... 2/6, 8, 16, 158–160, 2/161.1, 161.6, 167, 99, 339, 161.7, 2.11; 128/878, 879; 602/21

[56] References Cited

U.S. PATENT DOCUMENTS

| | | | |
|---|---|---|---|
| 3,772,706 | 11/1973 | Brigidi | 2/161 |
| 3,835,472 | 9/1974 | Duggins | 2/161 |
| 4,675,914 | 6/1987 | Mitchell | 2/161 |
| 5,113,526 | 5/1992 | Wang et al. | 2/161 |
| 5,476,439 | 12/1995 | Robinson | 601/40 |
| 5,628,069 | 5/1997 | Ebert | 2/161.1 |

OTHER PUBLICATIONS

National Aeronautics and Space Administration, "Comet", (approximately Nov. 1971).

*Primary Examiner*—Diana Oleksa
*Assistant Examiner*—Katherine Moran
*Attorney, Agent, or Firm*—William J. Zak, Jr., Esq.

[57] ABSTRACT

A counterpressure garment for blood supplied tissue is provided and comprises a spring capable of being in pressure contact with the tissue; and a supportive material covering at least a part of the spring. Also provided by the present invention is a space suit glove for a hand which comprises a spring capable of being in pressure contact with the palm of the hand; and a supportive material covering at least a part of the hand, with the supportive material being capable of exerting a force on the spring.

19 Claims, 3 Drawing Sheets

PALMAR SPRINGS FOR SPACESUIT GLOVES

BACKGROUND OF THE INVENTION

The present invention generally relates to vascular support garments. More specifically, the present invention relates to counterpressure garments that can be used in low pressure environments such as outer space.

In environments having very small or no ambient gas pressure, such as high altitude or the vacuum of space, a subject's respiration and circulatory balance are of concern. Gas needs to be delivered to the subject's lungs at a high enough pressure to cause diffusion of oxygen into the blood. It has been found that a gas pressure of about 222 mm Hg is minimally needed for proper breathing.

As pressure of the breathing gas rises, blood pressure similarly rises. But tissue pressure that substantially matches the blood pressure must exist. Otherwise, the circulating blood can rush into low pressure areas and pool. If tissue pressure is not sufficiently high, the veins (and particularly the small ones) will become engorged with blood. As venous engorgement continues, pressure within the veins and capillaries continues to increase. If the pressure exceeds about 10 mm Hg, measurable amounts of excess fluid can be forced through the capillary walls and accumulate in the tissues. The accumulation of fluid can result in edema and a decrease in the circulating blood volume.

To provide adequate pressure in the tissue to prevent pooling, various suits have been employed to provide a counterpressure on the tissue. Typically, these suits have used an inelastic and tightly fitted outer garment. The inelastic outer garment oftentimes covers bladders that apply constant counterpressure to the body. Also incorporated in the inelastic garment have been tubes running over the limbs and trunk. The tubes inflate, either from being gas filled or simply as the ambient pressure is decreased, pulling the suit material tight and thereby applying counterpressure to the body.

A different type of space suit is a "full pressure suit." It is a body-shaped garment that is gas tight and filled with oxygen under pressure so that the lungs and skin are pressurized equally. There is no circulatory imbalance.

While addressing some of the physiological concerns, the gas filled pressure suits have posed various problems. The inflated suit is rigid, except where special joint structures are added, and not all natural motions are thus possible. There is a relatively high energy cost of activity. Body temperature regulation due to the impermeability of the suit necessitates elaborate cooling systems. And with the need for pressurized gas within the suit, a danger associated with rupturing or tears exists. In the glove part of the suit, the gas causes the glove to balloon over the hand and severely limits dexterity.

In part to minimize the disadvantages associated with high energy cost and restricted mobility in gas filled suits, a space activity suit (SAS) was developed with elastic cloth material which itself provided countepressure to the body. No special joints are needed since the elastic cloth bends easily. The SAS also allowed direct evaporation of sweat in the absence of the type of cooling system associated with a gas filled suit. The SAS has also tended to be more flexible and less bulky than the gas filled suit, thereby increasing mobility.

Notwithstanding its advantages, the SAS still has drawbacks. For example, if a counterpressure is to be evenly applied around a circumference, a body part must be perfectly circular. But the body is not circular, and is instead ovate, ellipsoidal and irregular. Areas of the body which are far from circular include the hands, which have a concave palm and a convex dorsum. In the specific context of the hand, the elastic material tends to primarily press at the outer edge of the hand and, accordingly leave the dorsum and palm without significant counterpressure.

In an effort to address the problem of gaping, oil filled bags and pads have been used to fill the void in the gaps. But when such bags and pads are used in the glove of a suit, fluid accumulation has only been reduced, not eliminated. Perhaps more importantly, the bags/pads significantly impede dexterity. Also, as the need for more counterpressure increases, so does the need for a bag/pad which is larger and/or nonpliable. However, as the bag/pad increases in size and/or stiffness, dexterity decreases. Additionally, increased size and stiffness makes donning and doffing more difficult.

As can be seen, there is a need for an improved counterpressure garment for low pressure environments, such as outer space. Also needed is an improved counterpressure garment that can provide a counterpressure of about 222 mm Hg. A further need is for a garment that can provide counterpressure to blood supplied tissue that is significantly noncircular in shape and subject to frequent contraction, such as a human hand. Another need is for a space suit glove that not only provides adequate counterpressure to the palm and fingers of a hand but is also relatively easy to don and doff. Yet another need is for a method of equalizing a breathing pressure and tissue pressure in the palm of a hand. Such a space suit glove may be part of a complete SAS garment, or it might be used as the glove with a full pressure suit, or as the glove of a partial pressure suit.

SUMMARY OF THE INVENTION

The present invention is directed to a counterpressure garment for blood supplied tissue and comprises a spring capable of being in pressure contact with the tissue; and a supportive material covering at least a part of the spring. Also provided by the present invention is a space suit glove for a hand which comprises a spring capable of being in pressure contact with the palm of the hand; and a supportive material covering at least a part of the hand, with the supportive material being capable of exerting a force on the spring.

Also, the present invention provides a method of counterpressurizing blood supplied tissue and comprises the steps of placing a spring adjacent the tissue; covering at least a part of the spring with a supportive material; and flexing the spring to place the spring in pressure contact with the tissue.

These and other features, aspects and advantages of the present invention will become better understood with reference to the following drawings, description and claims.

DETAILED DESCRIPTION OF THE INVENTION

Figure 1:
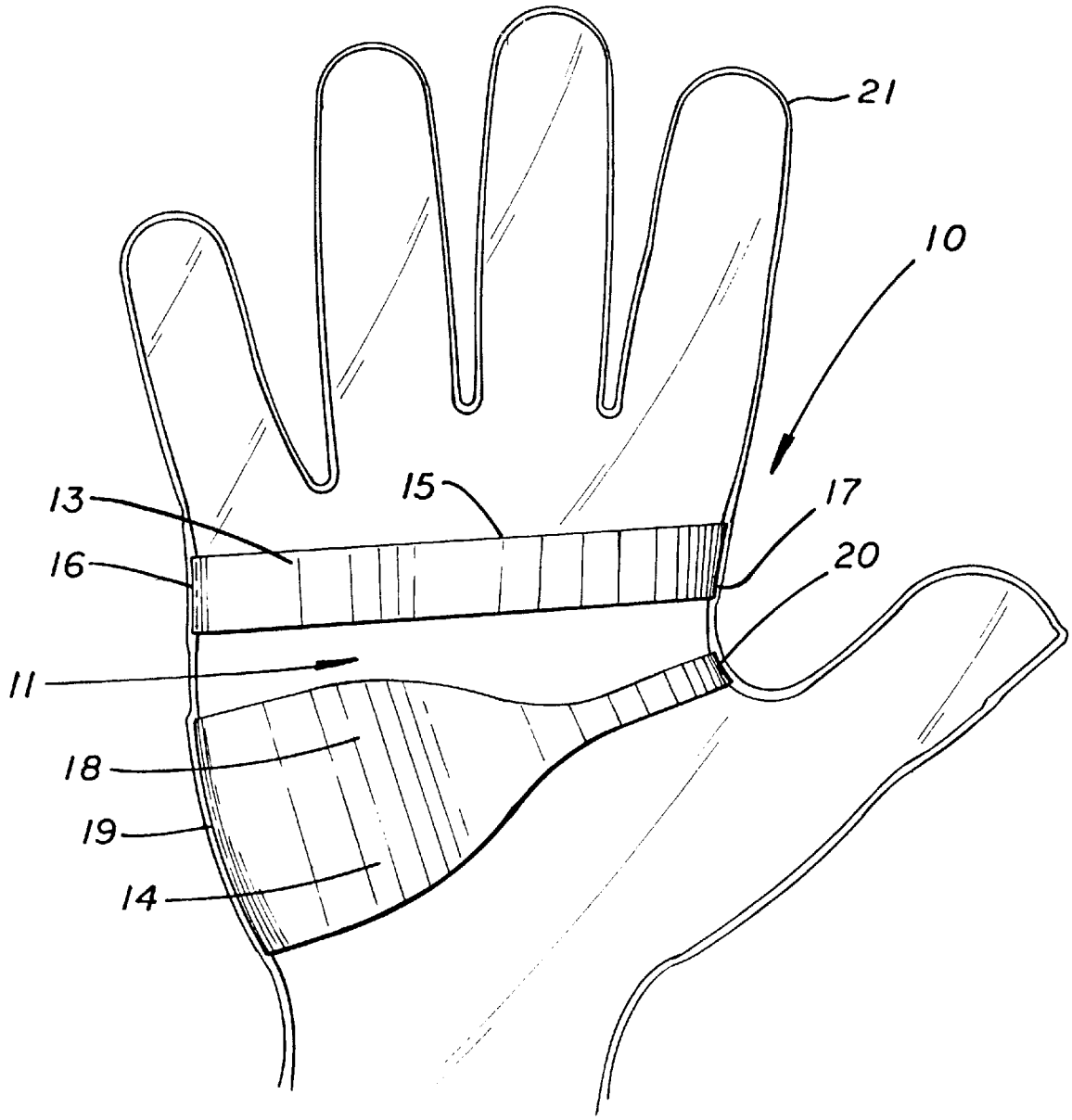
FIG. 1 depicts a palm of a hand covered by a counterpressure garment according to an embodiment of the present invention.

FIG. 1 depicts a counterpressure garment or glove 22 covering a palm 11 of a hand 10. The glove 22, in this embodiment, includes a pair of palmar springs 13, 14 and a supportive material 21 over the springs 13, 14. Generally, the supportive material 21 exerts forces F (FIG. 4) on the springs 13, 14, which cause them to flex in direction D and towards the palm 11. The flexure places the springs 13, 14 in pressure contact with the palm 11 to provide the necessary counterpressure for the particular breathing pressure, such as about 222 mm Hg.

Although the embodiment of the present invention is disclosed in the context of a garment 22 for a hand 11, it should be understood that the present invention can be utilized for other parts of a body and, thus, the garment 22 can be shaped into forms other than a glove. Further, while the present invention is described in the context of human subjects, it is contemplated that the present invention can be useful on nonhuman subjects. Additionally, even though the present invention is described in this embodiment as capable of achieving about 222 mm Hg in the environment of space, other counterpressures in other environments are contemplated.

In more particularly describing a specific embodiment of the present invention, the counterpressure garment 22 includes a supportive material 21 which is generally elastic in nature and shaped into a form to match a particular body part, such as the hand 10. Although various materials may be employed for the supportive material 21, examples of useful elastic materials include those manufactured by Carolina Gloves, Flint-Amtex, Ansel-Golden Needles, and Jobst.

While various supportive materials 21 may be employed, the choice of material 21 may be dependent, in part, on the amount of counterpressure to be achieved on the blood supplied tissue, as further described below. In other words, greater counterpressure may require a supportive material 21 that has less elasticity (i.e., stretches less with the same amount of force). Also, the sizing of the support material 21 can be used to alter the amount of counterpressure exerted, via the palmar springs 13, 14, on the tissue. Thus, for example, if the greater counterpressure is desired, the sizing of the support material 21 can be reduced to exert more force on the springs 13, 14, as further described below.

Figure 2:
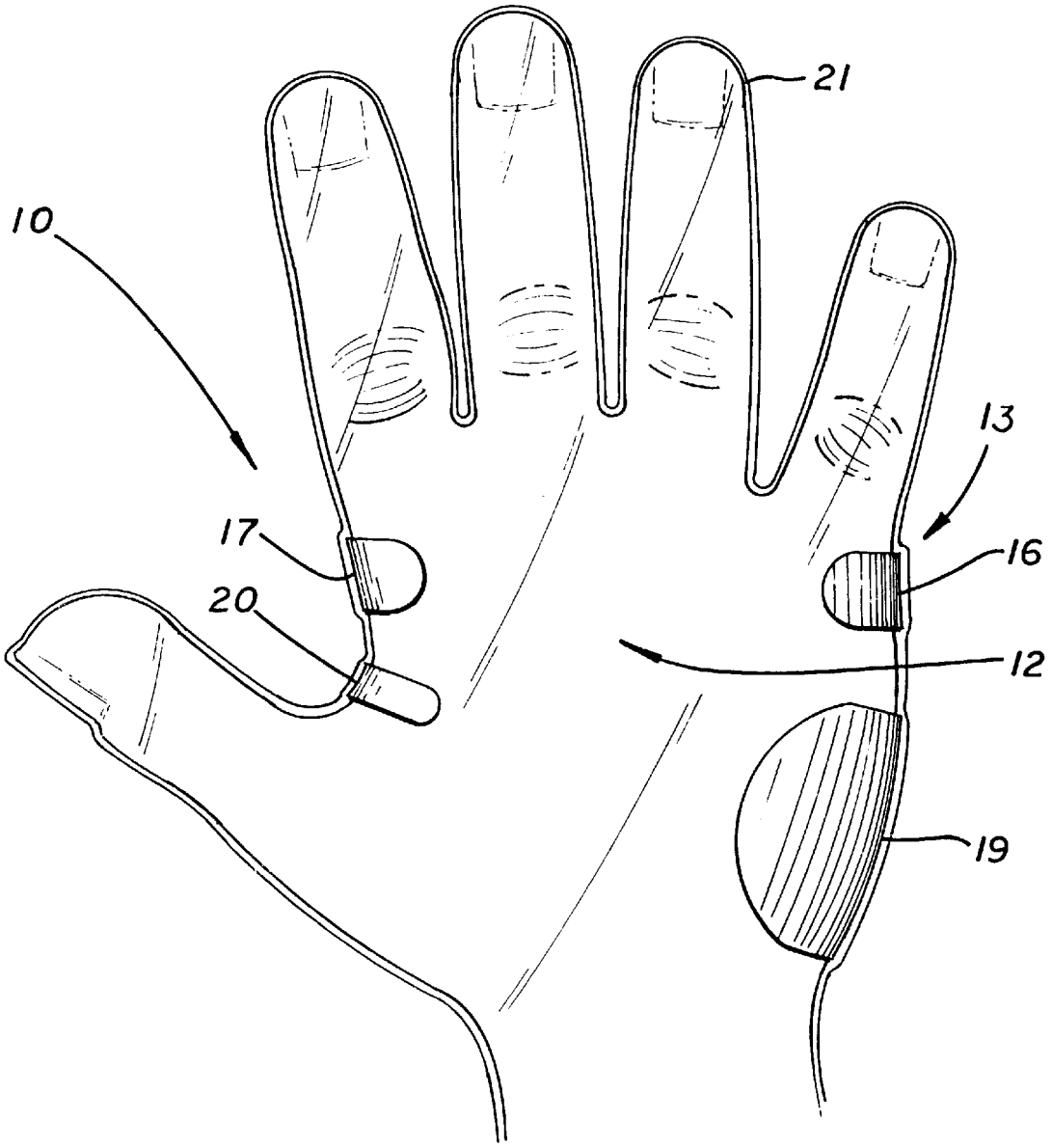
FIG. 2 depicts a dorsum the hand covered by the counterpressure garment shown in FIG. 1.

In the embodiment shown in FIGS. 1 and 2, the glove 22 also includes two palmar springs 13, 14. Although not depicted in the drawings, the springs 13, 14 can be attached to the inside of the glove 22, such as by sewing (not shown). And if greater comfort is desired, a cushioning layer (not shown) may be inserted between the springs 13, 14 and the palm 11. The cushioning layer may, for example, be of a foam or gel.

Both of the springs 13, 14 are generally of a leaf type construction and made of a material that can provide a spring-type force. Generally, the material to be used for the springs 13, 14 can be selected based upon the supportive material 21 being used and the amount of counterpressure that the springs 13, 14 are required to exert on the tissue, as further described above. For the environment of space, the present invention contemplates that graphite or carbon graphite is used.

As seen in FIG. 1, the spring 13 is shaped and configured to extend across the palm 11 and near the base of the fingers. The spring 13 is further shaped to wrap around the hand 10 and onto a dorsum 12 of the hand 10 (FIG. 2). The palmar spring 14 is shaped and configured to extend across the area of the palm 11 that is distal from the base of the fingers. As with the spring 13, the spring 14 is shaped to wrap around onto the dorsum 12.

Figure 3:
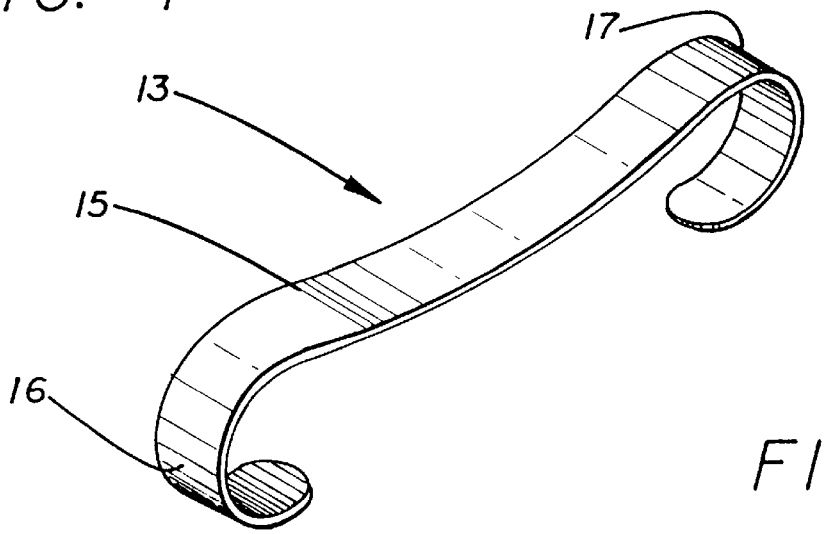
FIG. 3 is an elevated perspective view of a palmar spring according to an embodiment of the present invention.
Figure 5:
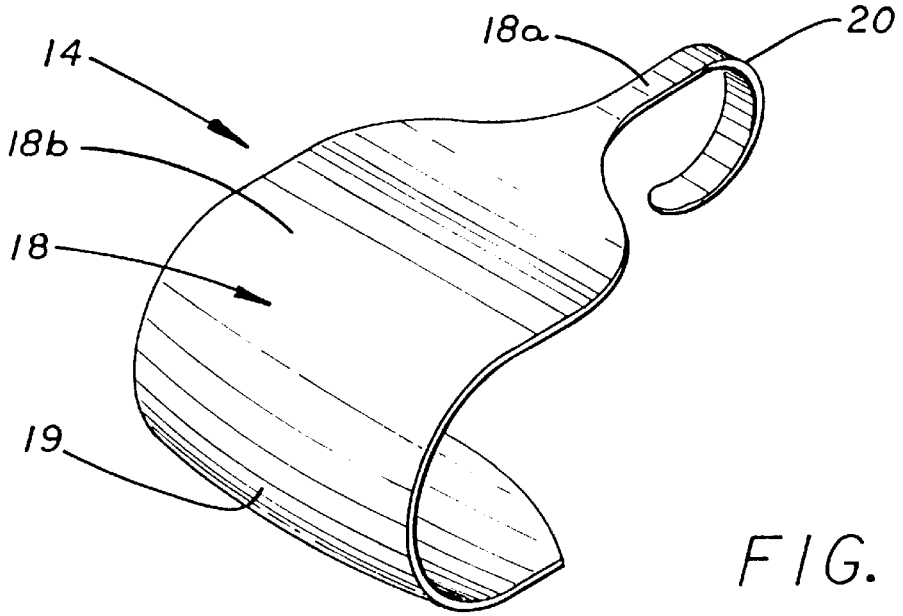
FIG. 5 is an elevated perspective view of a palmar spring according to another embodiment of the present invention.

As better viewed in FIG. 3, the palmar spring 13 includes a pair of compression portions 16, 17 located at the distal ends of the spring 13 with a counterpressure contact portion 15 therebetween. In this embodiment, the contact portion 15 can be generally described as substantially flat but with a slight convexity towards the palm 11. The contact portion 15 also has a substantially equal width along its entire length. The width of the contact portion 15 can be dimensioned to generally extend from the base of the fingers to where the hand 10 creates a crease when the hand 10 is in at least a partially closed position. From the two ends of the contact portion 15 extend the compression portions 16, 17, both of which are partially circular in configuration. In this embodiment, the compression portions have a width that is generally equal to the width of the contact portion 15, although the widths among the portions 15, 16, 17 can vary.

Figure 4:
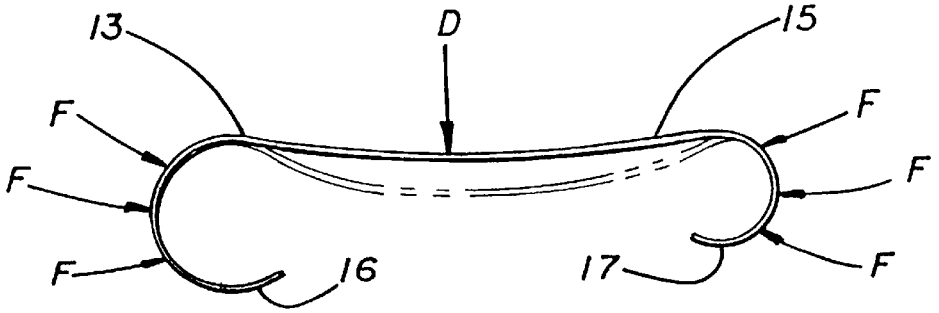
FIG. 4 is an elevated side view of the palmar spring shown in FIG. 3, as the spring is flexed.

In FIG. 4, it can be understood that the supportive material 21 has a particular elasticity and sizing that create forces F that are exerted on the compression portions 16, 17 located at the distal ends of the spring 13. With those forces F, the palmar spring 13 is caused to flex. Specifically, the contact portion 15 is caused to flex in the direction D, as shown in FIG. 4, and over a distance such that it becomes positioned as shown by the dashed lines. Thereby, the contact portion 15 can be placed in pressure contact with the tissue to be counterpressurized (not shown). The pressure contact, in turn, provides a counterpressure to the tissue. As can be appreciated, the amount of counterpressure can be controlled by tailoring the distance over which the contact portion 15 moves. More counterpressure can be achieved by more flexure. And more flexure can be achieved by greater forces F being exerted on the compression portions 16, 17 and/or by spring 13 simply being more flexible.

The palmar spring 14 is configured similarly to the spring 13. The palmar spring 14 includes a pair of compression portions 19, 20 at the distal ends of the spring 14 with a counterpressure contact portion 18 therebetween. In this embodiment, and unlike the contact portion 15, the contact portion 18 can be generally described as substantially flat but with a slight convexity to it. The portion 18 is comprised of a stem 18*a* and a body 18*b*. On an overall basis, the width of the contact portion 18 generally widens from the stem 18*a* and towards the body 18*b*. More specifically, the contact portion 18 is configured and dimensioned to match the portion of the palm 11 that is not covered by the palmar spring 13. In that fashion, the total area of the tissue to be counterpressurized is maximized or about equal to the total surface area of the contact portions 15, 18 juxtaposed to the tissue. From the two ends of the contact portion 18 extend the compression portions 19, 20, both of which are partially circular in configuration such that they wrap around the dorsum 12.

Just as with the spring 13, the spring 14 operates by forces F being exerted on the compression portions 19, 20 via the supportive material 21. Also like the spring 13, the contact portion 18 in the spring 14 is flexed and placed in pressure contact with the palm 11. Furthermore, the amount of counterpressure from the spring 14 can be controlled, as with the spring 13.

Even though the above embodiment has been described in the context of two springs 13, 14, it is contemplated that the present invention can utilize a single palmar spring or multiple springs in excess of two. Whether a single or multiple palmar springs are utilized may largely be dependent upon the total area of the tissue to be counterpressurized and the particular contour of the tissue. With a larger area to counterpressurize, a larger number of palmar springs may be desirable. This is because a single large palmar spring may be more difficult to flex for counterpressure (as further described below) when compared to multiple, small springs having a combined size substantially equal to the large spring. Multiple palmar springs may also be desirable when the tissue has different contours in different parts of the tissue. Thus, with multiple palmar springs, the shape of any one spring may require fewer different contours to match the contours of the tissue. With fewer contours to match, the spring may be more easily manufactured.

From the above, it can be understood that the present invention also includes a method for not only counterpressurizing blood supplied tissue but also a method of equalizing a breathing pressure and tissue pressure. Both methods include the steps of placing one or more palmar springs 13, 14 adjacent the tissue. At least a part of the springs 13, 14 are covered by the supportive material 21. By so covering, the supportive material 21 flexes the springs 13, 14 and places them in pressure contact with the tissue.

To those skilled in the art, it can be appreciated that the present invention provides a counterpressure garment that can be tailored to different contours of a body, including the hand. The present invention provides a simple construction, yet a garment that can achieve counterpressure upwards of about 222 mm Hg. In so doing, the present invention lowers the dangers associated with blood pooling and increases the mobility and dexterity of the user. In the context of space, the present invention can not only be used in an elastic SAS but also a gas filled, full pressure suit.

It should be understood, of course, that the foregoing relates to preferred embodiments of the invention and that modifications may be made without departing from the spirit and scope of the invention as set forth in the following claims.

I claim:

1. A counterpressure garment for blood supplied tissue, comprising:

a spring comprising a contact portion disposed between two distal ends; and a supportive material that exerts a continuous compressive force on said spring such that said contact portion is adapted to provide a continual counter pressure upon said blood supplied tissue of at least about 222 mm Hg.

2. The garment of claim 1, wherein said spring is capable of maintaining a substantially constant counterpressure on said tissue.

3. The garment of claim 1, wherein said spring is configured to follow a contour of said tissue.

4. The garment of claim 1, further comprising a plurality of springs in pressure contact with said tissue.

5. The garment of claim 1, wherein said supportive material is capable of exerting a substantially constant force on said spring.

6. The counterpressure garment of claim 1 wherein said spring comprises a leaf spring.

7. A vascular support garment for a substantially flat tissue, comprising:

a spring comprising a contact portion for exerting a continuous pressure on said substantially flat tissue, and two pressure portions; and a supportive material that exerts a continuous compressive force on said pressure portions such that said pressure portions are adapted to provide a continual counter pressure upon said blood supplied tissue of at least about 222 mm.

8. The garment of claim 7, wherein said spring is capable of flexing, thereby conforming its form to a contour of said substantially flat tissue.

9. The garment of claim 7, further comprising a plurality of springs in counter-pressure contact with said tissue.

10. The vascular support garment of claim 7 wherein said spring comprises a leaf spring.

11. A space suit glove for a hand, comprising:

a spring capable of being in pressure contact with a palm of said hands, said spring comprising a compression portion and a contact portion configured to receive a portion of said palm and a portion of a dorsum of said hand; and a supportive material covering at least a part of said hand, said supportive material being capable of exerting a force on said compression portion.

12. An improved space suit glove having a supportive material, wherein the improvement comprises:

a spring contoured to the shape of a palm of a hand, said spring being in compression contact with said supportive material such that said spring can be flexed into pressure contact with said palm, said spring configured to cover a dorsum part of said hand.

13. A method of counterpressurizing blood supplied tissue, comprising the steps of:

placing a spring adjacent said tissue;

covering at least a part of said spring with a supportive material; and flexing said spring to place said spring in a continual pressure contact with said tissue.

14. The method of claim 13, wherein the step of placing said spring comprises the step of placing a counterpressure contact portion adjacent said tissue, said counterpressure contact portion being configured to maximize an area of pressure contact between said spring and said tissue.

15. The method of claim 13, further comprising the step of utilizing a plurality of springs having a combined surface area that is substantially equal to an area of said tissue to be counterpressurized.

16. The method of claim 13, wherein the step of covering said spring comprises the step of exerting a force on said spring.

17. The method of claim 16, wherein the step of exerting a force comprises the step of exerting a force on at least a pair of compression portions in said spring.

18. In a low pressure environment, a method of equalizing a breathing pressure and a tissue pressure in a palm of a human hand, comprising the steps of:

placing a plurality of springs adjacent said palm;

covering said springs with a supportive material which is capable of exerting a force on said springs; and flexing said springs to apply a counterpressure on said palm, wherein at least one of said springs comprises a leaf spring.

19. In a low pressure environment, a method of equalizing a breathing pressure and a tissue pressure in a palm of a human hand, comprising the steps of:

placing a plurality of springs adjacent said palm;

covering said springs with a supportive material which is capable of exerting a force on said springs, thereby exerting a force on a plurality of compression portions located at distal ends of said springs; and flexing said springs to apply a counterpressure on said palm, wherein at least one of said compression portions is of semicircular configuration.

* * * * *

UNITED STATES PATENT AND TRADEMARK OFFICE

CERTIFICATE OF CORRECTION

PATENT NO. : 6,163,885
DATED : December 26, 2000
INVENTOR(S) : Paul Webb et al.

It is certified that error appears in the above-identified patent and that said Letters Patent is hereby corrected as shown below:

Title page,
Item "[75], Inventor," insert -- Kevin Abts, Hermosa Beach, California --.

Column 5,
Line 64, after "222 mm" insert -- Hg --.

Column 6,
Line 7, delete "hands" insert -- hand --.

Signed and Sealed this

Ninth Day of April, 2002

*Attest:*

*Attesting Officer*

JAMES E. ROGAN
*Director of the United States Patent and Trademark Office*